US010012154B2

(12) United States Patent
Levy et al.

(10) Patent No.: US 10,012,154 B2
(45) Date of Patent: Jul. 3, 2018

(54) REDUCED POWER CONSUMPTION WITH SENSORS TRANSMITTING DATA USING CURRENT MODULATION

(71) Applicant: Infineon Technologies AG, Neubiberg (DE)

(72) Inventors: David Levy, Wernberg (AT); Derek Bernardon, Villach (AT)

(73) Assignee: Infineon Technologies AG, Neubiberg (DE)

( * ) Notice: Subject to any disclaimer, the term of this patent is extended or adjusted under 35 U.S.C. 154(b) by 710 days.

(21) Appl. No.: 14/540,259

(22) Filed: Nov. 13, 2014

(65) Prior Publication Data

US 2016/0138492 A1 May 19, 2016

(51) Int. Cl.
*F02D 29/02* (2006.01)
*F02D 41/28* (2006.01)

(52) U.S. Cl.
CPC ..... *F02D 29/02* (2013.01); *F02D 41/28* (2013.01); *F02D 2041/281* (2013.01); *F02D 2041/285* (2013.01)

(58) Field of Classification Search
CPC ..... F02D 2041/281; F02D 2041/285; F02D 29/02; F02D 41/28
See application file for complete search history.

(56) References Cited

U.S. PATENT DOCUMENTS 8,207,859 B2 * 6/2012 Enegren ..... A61B 5/0031 180/272
2009/0270705 A1 * 10/2009 Enegren ..... A61B 5/0031 701/1
2010/0286864 A1 * 11/2010 Kawauchi ..... G01S 5/0072 701/36
2012/0003863 A1 * 1/2012 Sung ..... H04Q 1/136 439/489

* cited by examiner

*Primary Examiner* — Hieu T Vo
*Assistant Examiner* — Arnold Castro
(74) *Attorney, Agent, or Firm* — Eschweiler & Potashnik, LLC

(57) ABSTRACT

An engine control system operates to communicate via a sensor link with one or more sensors in a vehicle based on different communication protocols. The sensors alter communication protocols for communicating via the sensor link to an engine control unit to reduce or increase a current consumption according to one or more predetermined criteria. In response to a predetermine threshold of one or more of the predetermined criteria being satisfied, a sensor communicates in a first communication protocol as opposed to a second communication protocol while operating to communicate a current signal or a modulated current signal.

25 Claims, 7 Drawing Sheets

REDUCED POWER CONSUMPTION WITH SENSORS TRANSMITTING DATA USING CURRENT MODULATION

BACKGROUND

Functional safety represents a clear differentiator for current and future products in various industries, such as in automotive productions, for example. To achieve corresponding targets in terms of automotive safety integrity level (ASIL), new and enhanced concepts have to be established. To achieve a dedicated ASIL level, different target parameters as failures in time (FIT) rate, diagnostic coverage, SPFM, LPFM, etc., have to achieve a dedicated value.

Modern vehicles include a vast array of sensors, such as air bag sensors, tire pressure sensors, engine sensors, seat belt sensors, and many others. The air bag sensors, for example, provide data about the vehicle's operation (e.g., wheel speed, deceleration, etc.) to an engine control unit (ECU), an airbag control unit (ACU) or other vehicle controller. Based on the data received from the sensors, the control unit can determine when air bags or other subsystem within a vehicle should be operational.

As the number of vehicular sensors increases, integration becomes a serious challenge for automakers. For example, wires connecting an ACU to its corresponding air bag sensors can be several meters long. These wires are a significant cost factor in automotive systems and contribute to the overall weight of the vehicle, but can be reduced by the communication interface. High current can also be consumed by the sensors using current modulation to transmit data to the ECU or other control unit. The high average current consumption can call for heat dissipation mechanisms, which can increase area and reduce reliability. Additionally, high current transmitted along long cables or pathways can generate strong emissions. Thus, reducing the current can reduce operating temperatures and emissions, and thereby increase the device reliability.

DETAILED DESCRIPTION

Figure 1:
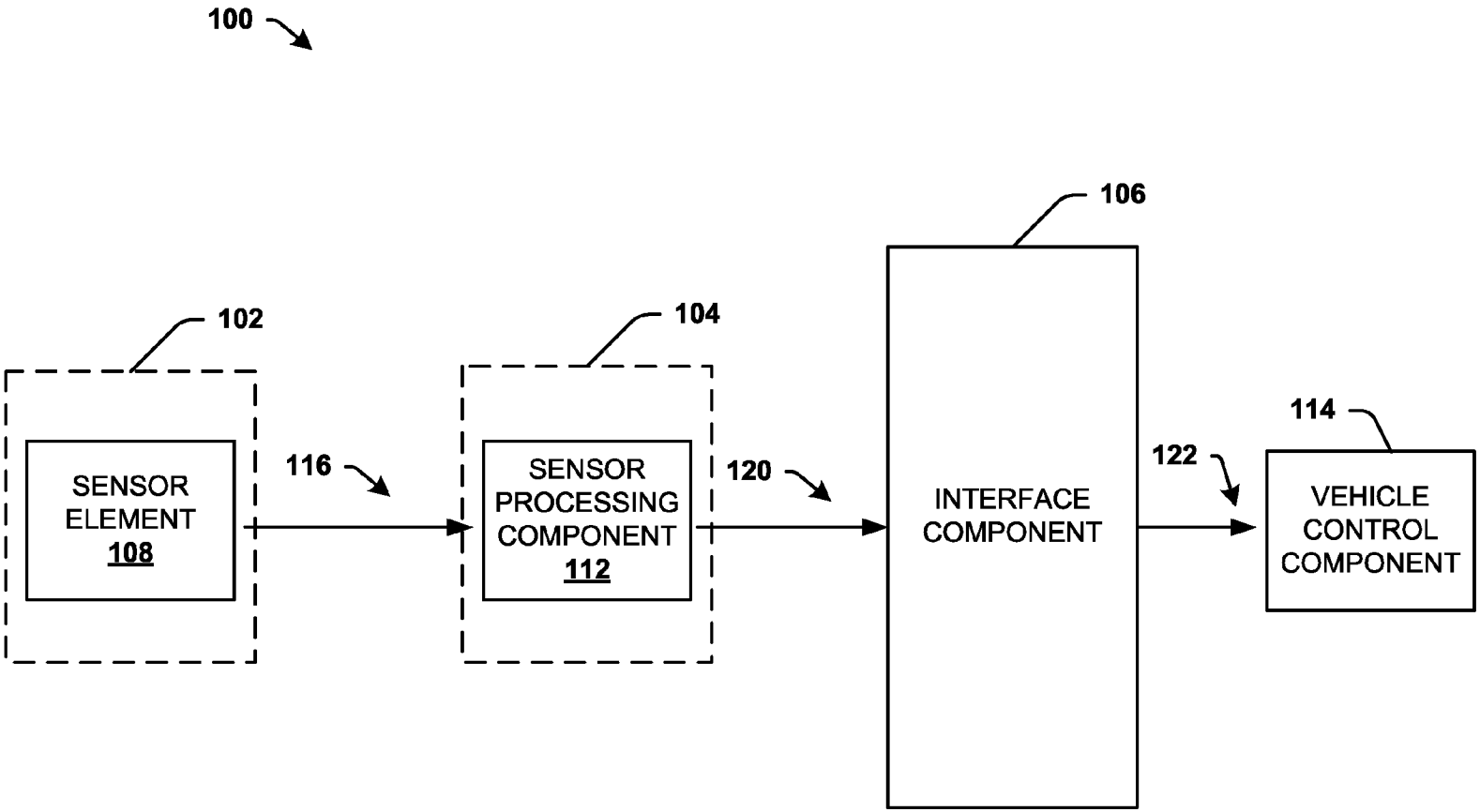
FIG. 1 is a block diagram of a vehicular control system in accordance with various aspects disclosed.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," and the like are intended to refer to a computer-related entity, hardware, software (e.g., in execution), and/or firmware. For example, a component can be a processor, a process running on a processor, a controller, an object, an executable, a program, a storage device, and/or a computer with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the extent that the terms "including", "includes", "having", "has", "with", or variants thereof are used in either the detailed description and the claims, such terms are intended to be inclusive in a manner similar to the term "comprising".

In consideration of the above described deficiencies, various aspects are directed towards a vehicular control system having an ECU, a control component, a power train control module (PCM), or like processing control unit or component that controls one or more sub-systems, actuators or sensors to ensure optimal engine or system performance of a vehicle. The vehicular control system can further comprise a sensor system of one or more sensors that detect one or more physical parameters. A sensor interface component can modulate and transmit measurement data of the physical parameter (e.g., a sensed quantity, a measured quantity, a sensor signal, one or more signal components for a sensed signal, or other parameters) via an interface without compromising data rate and information integrity. For example, one or more sensors can detect data of a physical quantity with one or more sensor elements and communicate the data in different representations via the sensor interface to a control unit (e.g., ECU or PCM), which, in turn, can control one or more sub-systems based on the data received. One or more sensors can operate to communicate detected data related to the physical parameter to the control unit, for example, based on one or more predetermined criteria. The predetermined criteria, for example, can include a change of one or more properties or conditions related to the physical parameter/quantity, one of a plurality of different communication protocols, or aspects or characteristics of the different communication protocols (e.g., counter values, start bits, error detection coding or parity bits, data bits, etc.). The predetermined criteria can further comprise one or more different ADIL levels corresponding to a given sensor or sensor sub-system, different interface standards, threshold limits related to size and amount of data, as well as measurement change or measurement difference limits. The predetermined criteria can further comprise a maximum or a minimum of a frequency of communication values or communications related to the current communication protocol mode, parameters related to a crash or an accident mode of operation, a reference measurement, a prior measurement of the related physical parameter, or other similar predetermined criteria as discussed herein.

In one aspect, the sensor of the vehicle system is coupled to a control unit via the interface such as a peripheral serial interface (e.g., PSI5) or a digital serial interface (e.g., DSI3), wherein the sensor communicates in a communication protocol from among different communication protocols depending upon the predetermined criteria. The communication protocol of the sensor can dynamically change based on a current consumption target, or the protocol can change based on a trigger to the sensor or the sensor interface by a protocol component. For example, the sensor can communicate in a current reduction mode, in which the vehicle system can trigger one or more sensors to transmit at every Nth data synchronizing period, in which only a portion of or less than all of a complete/entire data frame or word (e.g., including all start bits, data bits and error detection or parity bits) as related to a current signal or a modulated current signal of the sensor is communicated. In addition, the sensor is configured to communicate in a different communication protocol, such as for an increased current consumption mode as compared to the reduced current consumption mode in response to a change in the predetermined criteria. Additional aspects and details of the disclosure are further described below with reference to figures.

FIG. 1 illustrates an engine control or vehicular sensing system 100 for a vehicle (e.g., an automobile or other motorized vehicle) that operates to transfer sensed data and information along processing paths and stages in accordance with various aspects disclosed. The system 100, for example, can comprise a sensor or a sensor processing stage 102 coupled to a signal processing stage 104 and an interface component 106, which can operate in conjunction to with one another to provide an output at a node or terminal. The output 122, for example, can be generated from one or more different communication protocols or data representations and can be coupled to a vehicle control unit or other vehicle control component 114, in which each communication protocol can be based on a different set of predetermined criteria.

The system 100 includes the sensor 102 that can comprise one or more sensor elements 108 configured to detect a physical parameter, property or quantity. The sensor 102 can receive or generate a signal or a signal component of a sensed measured quantity or property (e.g., a quantity of heat, pressure, magnetism, direction, orientation, acceleration, viscosity, flow, displacement, etc.) for generating an output signal of the sensed quantity at the interface output. The sensor element 108 can independently provide signals or different signal components of an output signal to one or more sensor signal processing pathways 116 respectively, which can be a single-ended or a differential pathway that communicates single ended or differential signals related to the physical parameter.

The sensor processing component 112 of the sensor processing stage 104 can receive one or more signals of the detected physical parameter from the sensor 102 or element 108, and further process the signals for communication to the control unit or other control component 114 (e.g., ACU, ECU, or the like) via the interface component 106. The sensor processing component 112, for example, can operate to process a current signal derived from the sensor element 108 of the sensor 102, and can include one or more of normalizing components, temperature calibration components, filters, calculating components (e.g., angle calculations or the like), analog-to-digital components (ADC), or control units comprising a processor or other device components for processing and performing operations related to each.

In one aspect, the sensor processing component 112 can comprise a protocol processor that is configured to detect one or more properties of the current signal or of the modulated current signal (e.g., amplitude, frequency, direction, a change of signal, etc.) and determine whether a first predetermined threshold has been satisfied to trigger a change in a communication protocol from one to another. For example, the predetermined threshold can relate to an amount of change to the physical parameter as detected by the sensor 102 or the sensor element 108. The sensor 102 or the sensor element 108 could indicate that one or more properties related to the physical parameter have changed. The sensor processing component 112 can then operate to modify the first communication protocol of the first sensor to a second communication protocol in response to the change being greater than or equal to a threshold value.

In one example, the predetermined threshold can comprise a set threshold value for a change in the physical property as detected in the current signal or a modulated current signal for a physical parameter, such as a pressure, for example, or a different physical property or parameter (e.g., acceleration, direction, angle, electrostatic force, etc.). This change can be determined by a difference from an actual measurement and a reference measurement, as determined by the sensor processing component 112, for example. The actual measurement can represent the most recent measurement or detection of the physical parameter, while the reference measurement represents a prior measurement or a detection of the physical parameter, either at a point in time, over a period of time, over a number of data synchronization periods with respect to a counter, a measurement generated within a steady-state condition of the sensor signal, either at point in time or over a period of time, or other reference stored in a memory, for example.

In another aspect, the threshold could be satisfied in response to the physical parameter exceeding, being equal to or dropping below the set threshold value. The threshold could be satisfied, for example, if the difference between a measurement result and a reference measurement becomes outside of a normal range of values or of a statistical deviation. For example, the system 100, via the protocol processor 112 of the processing stage 104, can also dynamically determine the reference measurement as being an average that is calculated along a steady-state portion of a current signal or modulated current signal related to the physical parameter being detected. The reference can be dynamically determined, for example, by the protocol processor signal processing component 112 updating the reference value as the last transmitted measurement that was transmitted via a complete or full data frame or word, or dynamically updated at each transmission according to the other representations discussed above. Alternatively or additionally, the reference measure could be a reference measurement stored in a memory coupled to the sensor processing component 112.

The sensor processing component 112 can further operate to determine the reference measurement dynamically so that steady state modes or regions of the current signals can be analyzed and stored in one or more memories with values related to the physical parameter being inspected. In response to a predetermined threshold being satisfied with respect to the stored reference measurement (e.g., an average, mean or other statistical measure) based on the steady state analysis, the sensor processing component 112 can facilitate a change in communication protocol, such as by triggering the sensor 102 to communicate in a different mode (e.g., a crash or accident mode, a first communication protocol mode, a second communication protocol mode that is different from the first, a normal mode, or the like). The sensor 102 can operate in each mode to further facilitate a change in a current consumption, either by a decrease or an increase in current with respect to the different modes. In situations, times or for different targets, where, for example, a parameter of the current signal does not change or is not expected to change drastically according to the threshold values, then a low current could be facilitated via the communication mechanisms. As such, the current being drawn from a battery or current supply at the interface component can be saved and lower overall power consumption in the system as a result of a change in the communication protocol or a dynamic adaptation of the communication protocol as a function of the changing properties being sensed by the sensor, different predetermined thresholds corresponding to various conditions, or a change in one or more of the predetermined criteria detected or stored by the system 100.

In another aspect, different thresholds can also be dynamically determined by the sensor processing component 112 and facilitated by a communication protocol trigger or signal to the sensor 102. For example, a first predetermined threshold can comprise, or be related to, a threshold that is related to a change (e.g., a difference in an actual measurement or in a reference measurement from an earlier sensed reading, stored or multiple readings over a sensor steady state condition, etc.) in the current signal or in a modulated current signal, which is related to the physical parameter detected by the sensor 102. In addition or alternatively, a second threshold can comprise a different threshold that can be related to whether a crash mode or an accident mode is occurring, in which a vehicle is in an accident state. The second predetermined threshold could be from a different sensor or from the same sensor 108 at a different threshold level (e.g., as a change, a frequency, or an amplitude level) than the first predetermined threshold, such as a higher threshold level than what corresponds to another communication protocol, or a higher predetermined threshold than the first predetermined threshold. In this manner, the system can facilitate the sensor 102 to communicate in different communication modes based on a severity of the sensor data for control of the vehicle and according to different corresponding predetermined thresholds.

For example, in one mode of operation, a first communication protocol can be implemented that reduces current and communications the most, such as in response to no data being communicated over a time period, in which after a defined number of periods at least a portion of or a full data frame is transmitted again. In another mode, some data, but not all, can be communicated to reduce current consumption to an intermediate level or intermediate mode (e.g., between a reduced current mode and an increased current mode of consumption, which connotes a lowest and a highest respectively) by sending a shorter data frame or word than a complete frame at each data period or data synchronization period. In another mode, slightly more than the intermediate level of current (e.g., an advanced or intermediate current consumption mode) can be consumed by the sensor or sensor interface by sending a difference or a difference value in two measurements (a previously transmitted measurement and a current measurement). In another mode, a complete full frame or word can be transmitted at each period of data synchronizing (e.g., in the increased current mode or a maximum current consumption mode, in other words).

Additionally or alternatively, the sensor processing component 112 or the interface component 106 can be configured to detect the predetermined criteria that relate to the different communication protocols, the sensors (e.g., sensor 102, or sensor element 108) coupled within the system 100, the predetermined thresholds related to each sensor or communication protocol and threshold conditions, data related to the signal properties or the physical parameters, or other criteria such as target levels, or safety values (e.g., function safety or ASIL levels assigned to each sensor sub-system or each individual sensor). As such, the sensor processing component 112 can operate to ascertain the predetermined criteria, either dynamically, externally via signaled communication or via one or more data stores. In response to ascertaining the predetermined criteria or a change to one or more of the predetermined criteria, different sensors, for example, can be assigned different communication protocols based on different sets of predetermined criteria. For example, in one sensor, an ASIL D level can be assigned as the functional safety level for operations of the sensor, which is a highest or most critical level for safety, and thus an increased current consumption mode (e.g., a full data frame communication at each synchronization period) could be assigned or an advanced current mode (in which a different of measurements is communicated for a set number of synchronization periods until a full data frame is communicated). Likewise, one or more other automotive functional safety levels can be assigned to different sensors or sensor sub-systems of the vehicle according to corresponding predetermined criteria. For example, each sensor can be assigned to at least one of ASIL D, ASIL C, ASIL B, ASIL A or no ASIL. Based on which safety level or no safety level corresponding to the sensor, the signal processing component 112 can modify the sensor communication protocol from among various corresponding communication protocols. Other predetermined criteria, as discussed throughout this disclosure, can also be detected, assigned or varied among the sensors, can be assigned to different synchronization periods, or to different modes of a particular sensor according to the various sensor communication protocols being disclosed.

In another example, additional sensors can indicate that various changes from a steady state of one or more different parameters or the same parameter as the sensor element 108 are occurring, in which the control unit 114 is initiated to facilitate emergency, crash or accident protocols. In response to an external trigger (e.g., from one or more other sensors or sensor elements), for example, the sensor processing component 112 is configured to facilitate a change in a communication protocol with the sensor element 108 or sensor 102.

In addition or alternatively, the second predetermined threshold can comprise a different level or value threshold for current signal or current modulated signal from the sensor 102 as related to the same physical parameter being detected originally. In this case, different thresholds associated with the same properties (e.g., physical parameter) of the current signal or current modulated signal can trigger different communication protocols. For example, a steady state mode or a normal state mode can trigger or facilitate a first communication protocol, in which little change in the physical parameter is detected. A first differential or a difference (e.g., between at least two measurements) that has a larger change between a measurement and a reference measurement can operate to trigger a different communication protocol, and a second, different differential having an even larger or different change detected between the measurement and the reference signal could trigger a third different communication protocol. Each communication protocol can facilitate different advantages as well as different operating conditions such as a difference in current or power consumption by the sensor 108, the sensor processing component 112, or the interface component 106 in communicating a current signal or a modulated current signal to the vehicle control component 114.

In another aspect, the sensor 102 can communicate detected data related to the physical parameter that is processed via the sensor processing component 112, which, in turn, can modulate the detected data into a modulated current signal, and further communicate the modulated current signal via the communication path 120 to the interface component 106. The interface component 106, for example, can comprise a Peripheral Serial Interface 5 (PSI5) interface or a Digital Serial Interface 3 (DSI3) interface as a connection or link to the control unit 114 for modulating the current signal and communicating the current modulated signal to the vehicle control component 114. Alternatively, other interface connections or interface components can also be envisioned for communication in at least one of a plurality of different communication protocols. Further, the predetermined criteria can further include data related to the availability of each corresponding interface, or the type of data (e.g., symbol or start bits of a full data frame) to be communicated or modulated for each corresponding interface for a selected communication protocol or a mode of sensor operation.

The sensor processing component 112 is configured to reduce a current consumption over one or more periods of data synchronizations by adjusting or modifying communication protocols of the sensor 102 or the sensor element 108. For example, the sensor 102 can be configured to communicate in a different communication protocol in response to a trigger from the sensor processing component 112. The sensor 102 can communicate detected properties of the physical parameter in a reduced current consumption mode, in which communication of data occurs with less current consumption or comprises a lower current consumption average over one or more synchronization periods as compared to a different communication protocol.

In another aspect, the sensor 102 or a different sensor of the system can be configured to communicate in an increased current consumption mode and increase the current consumption of the sensor 102 in response to a trigger (e.g., the predetermined threshold, as discussed above, being satisfied) or a trigger communication received from the sensor processing component 112 or other component of the system, for example, which can modify the communication protocol being utilized for the communications by the sensor 102. The increased current consumption mode can comprise a greater current consumption or a greater average current consumption in the sensor 102 over one or more synchronization periods for data synchronization as compared to the reduced current consumption mode of operation, or over other current consumption modes, which can be facilitated by a change in the communication protocol, a change in the predetermined criteria or in the parameters being utilized by the particular communication protocol (e.g., a frame length, or other communication criteria).

Each period or data synchronization period, for example, can correspond with a clock, an oscillator, or a counter value in which the sensor 102 detects a physical parameter via the sensor element 108 and transmits any detected difference in the parameter, a datum or a value of the physical parameter (e.g., via a full data frame) to the sensor processing component 112 and the control unit 114. Each synchronization period can correspond to a synchronization of the data being detected by the sensor 102 and the sensor processing component 112 or the control unit 114, which can occur at each synchronization period or counter value increment, for example, or at N number of synchronization periods, wherein N is an integer of at least two.

One communication protocol of the plurality of communication protocols, for example, can comprise a communication of no data via a current signal or a current modulated signal over a fixed number of N synchronization periods, wherein N is an integer and greater than or equal to one (e.g., 7, 8 or like number). Another communication protocol can comprise a communication of data that is less than an entire, a complete, or a full data frame or full data word over the fixed number or a different number of synchronization periods. For example, an entire, a complete or a full data frame or a data word can comprise all bits in a packet or a communication that would be transmitted during a full current or an increased current mode of communicating, which would be transmitted entirely in an increased current consumption mode, a crash mode or other data sensitive critical mode of operation for the vehicle. An entire, a complete or a full data frame or data word, for example, can include one or more start bits or known bits, one or more error detecting or parity bits (e.g., a cyclic redundancy check bit, or the like), and one or more data bits (e.g., six bits or a like word) that includes all data related to the most recent detection by the sensor 102 of the related physical parameter, for example. As such, less than the entire, complete or full data frame or word can comprise some data related to the physical measurement, but not a complete or full data frame, such that, for example, the data communicated only includes a difference between a measurement result and a reference measurement (e.g., a stored value, a steady-state average, a prior measurement, or the like). The difference, for example, can be a difference in transmitted data from a last transmitted data frame that was a shorter data frame (e.g., less than an entire data frame represent a difference of two measurements) and a change in the difference with respect to an additional measurement that represents any change in the physical parameter from the last measurement or last sent data frame of the measurement. Alternatively, the difference, for example, can be a data frame representing a difference in the actual measurement from a previous measurement to a current measurement or a reference measurement that is related to the physical parameter sensed by the sensor. In another aspect, less than the entire, complete or full data frame or word (a shorter data frame) can comprise at least one of no data, only the start bits (e.g., one, two of three bits), a symbol, a sensor ID of the symbol, a keep-alive counter value, or the like, in which no actual data that is indicative of or related to the most recent detection by the sensor 102 is included. The sensor processing component 112 can further be configured to trigger whether a symbol such as a sensor ID or a keep alive counter value is communicated or whether only the start bits are communicated based on the type of interface to be utilized, such as a PSI5 interface or a DSI3 interface respectively.

In addition or alternatively, as stated above, the different communication protocols can correspond to different ASIL levels, which can further correspond to the different reaction times associated with each ASIL level and a given sensor. For example, ASIL A or ASIL B can have a longer reaction time, or a higher N synchronization period value and be assigned to one sensor, while ASIL C or ASIL D can be assigned to another sensor, or the one sensor in response to a change in predetermined criteria associated with the one sensor, for a shorter reaction time and with a different or lower N synchronization period value compared to ASIL A or ASIL B. Further, the communication protocols can be assigned differently based on these criteria. For example, the sensor with a higher N synchronization period value associated with ASIL A or ASIL B can change between all of the communication protocols discussed herein (e.g., no data being sent, a shorter data frame being sent or a full data frame), while another association with the lower N synchronization period compared to the higher and with ASIL C or ASIL D can be changed between less than all of the communication protocols discussed herein for a faster reaction time. Additional combinations of communication protocols can be envisioned as being dynamically implemented based on the predetermined criteria and various thresholds discussed herein, either by changing among sets of different communication protocols within the same sensor or with different sensors dynamically within the systems.

The sensor 102 can be configured to communicate in the communication protocol less than the entire, complete or full data frame or word based on the interface component 106 having peripheral serial interface 5 (PSI5) interface or a digital serial interface 3 (DSI3) interface available or selected to communicate the current modulated signal to the control unit 114. In the case of a PSI5 interface utilized for communication, less than the entire, complete or full data frame or word can include the start bits only. Alternatively or additionally, in the case of communication via a DSI3 interface, the sensor 102 can communicate one or more symbols having a shorter data frame or word of data that comprise a keep-alive counter or a sensor ID only, rather than a complete frame or a larger data frame or data word, such as the entire, complete or full data frame or word.

The interface component 106 can be configured to modulate the current signal from the sensor 102 or sensor element 108 with one or more pulse trains or carrier signals to communicate or transmit data over a communication channel 122 (e.g., a low pass channel or the like) or interface based on the current communication protocol. The current signal can be modulated by one or more different line codes or the like, such as Manchester coding, alternate mark inversion coding or other modulation coding, for example, in which the disclosure is not limited to any one modulation technique or modulation architecture.

Figure 2:
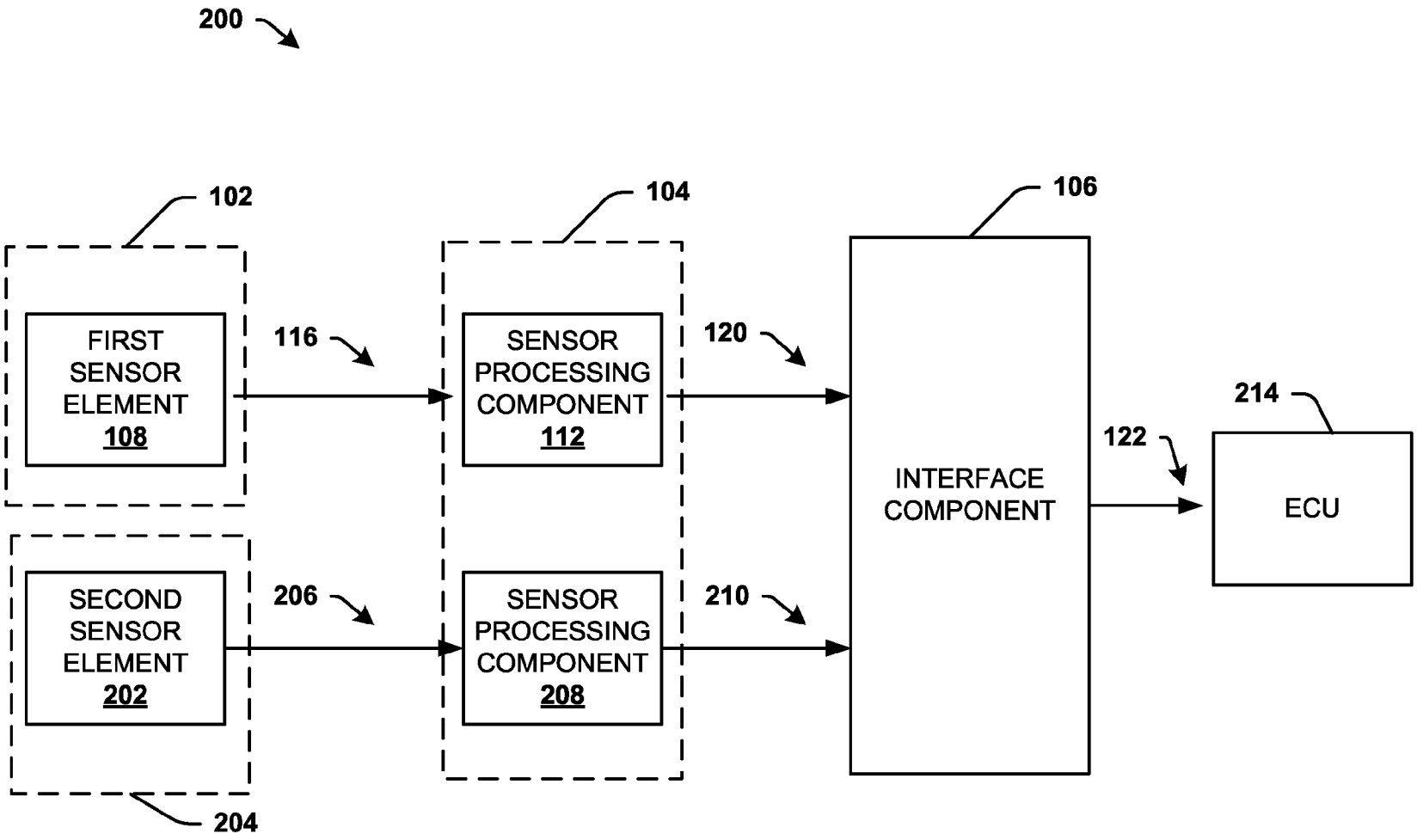
FIG. 2 is another block diagram of a vehicle control system in accordance with various aspects disclosed.

Referring to FIG. 2, illustrated is another example of a vehicular control system 200 that communicates sensor data in different modes of operation or in different communication protocols in accord with various aspects described. The system comprises similar components as discussed above, and further comprises a second sensor 204 with a second sensor element, a second signal processing path 206, and an additional sensor processing component 208 coupled to the interface component 106 via communication path 210. The interface component 106 is further coupled to an engine control unit (ECU) or other control unit 214 via one or more sensor interface connections 122 (e.g., a peripheral serial interface connection (PSI5) or a digital serial interface connection (DSI3)).

The different signal processing pathways 116 and 206 can be independent from one another and provide sensed data related to different physical parameters via the different sensor elements 108 and 202 of different sensors 102, 204. Alternatively, first and second sensor elements 108 and 202 can be a part of the same sensor and provide sensed data related to the same physical parameter in different representations along the signal pathways 116, 206 as differential signal paths that communicate the different representations along each path of the same sensed parameter, for example. Each sensor element 108 and 202, or each sensor 102 and 204 can communicate in different communication protocols based on a set of predetermined criteria and modify the communication protocol from one to another different communication protocol according to one or more predetermined thresholds.

For example, the predetermined criteria can comprise operations, values, or properties that can vary for each different communication protocol. The predetermined thresholds can include one or more values, conditions or times upon which a determination is made to facilitate a change of a communication protocol used by a sensor. The predetermined criteria, for example, can comprise a number of N periods to communicate either a portion of a data frame of the modulated current signal or communicate no data frame. The portion or less than a complete data frame can comprise a shorter data frame than the complete data frame, which can comprise only a sensor ID, a set of start bits, or a symbol that includes a counter value or the sensor ID bits.

In one aspect, the portion of the data frame can be without any data bits that are related to the sensed physical parameter. In another aspect of the disclosure, the portion of the data frame can be a communication that comprises a shorter frame or less data than a complete data frame, such as a difference between an actual or last measurement and a reference measurement. The actual or last measurement can be the most recently detected quantity related to the physical parameter by a sensor, while the reference measurement can comprise a steady state value, a prior measurement transmitted, a stored value, an average of measurements over a duration of steady state, or other range of statistical deviation related to a sensed detection of the physical parameter. The number N can be the number of data synchronization periods, which correspond to each sensor data transmission, in which N can be an integer that is equal to or greater than one. The criteria can be implemented as part of the communication protocol of the sensor in response to a determination by the protocol component of whether a predetermined threshold is satisfied or is not satisfied.

In addition, as discussed above, the predetermined criteria, for example, can include a change of one or more properties related to the physical parameter/quantity, one of a plurality of different communication protocols, aspects or characteristics of the different communication protocols (e.g., counter values, start bits, error detection coding or parity bits, data bits, etc. as part of a communication), ASIL levels, interface standards or type of interface, threshold limits related to size and amount of data, as well as measurement change or measurement difference limits, a maximum or minimum of a frequency of communication values or communications related to the current communication protocol mode, parameters related to a crash or an accident mode of operation, a reference measurement, a prior measurement of the related physical parameter, a priority of the sensor or other similar predetermined criteria.

In one scenario, the first sensor 102 can communicate in a reduced current mode by utilizing a communication protocol, in which only a complete or full data frame or word is transmitted by the sensor or interface at every N+1 periods of data synchronization. Thus, a reduction in the amount of communication is facilitated by a triggering of this communication protocol via signal processing component 112 to the sensor 102. At the same time or concurrently, the second sensor could communicate in another communication protocol, for example, in which the complete or full data frame or word is only communicated at every N+1 periods, but at each of the N periods before the N+1 period, where the sensor communications comprise a difference in measurements (e.g., between a recent measurement and a past reference measurement, or between a last/prior measurement or a recent reference measurement of the physical parameter).

Alternatively to communicating the difference, the second sensor 204 or another sensor can communicate in a different communication protocol according to different predetermined criteria with less than the entire or complete data frame, such as the data frame having the start bits only, the sensor ID bits only, or a symbol comprising a counter value that indicates the period of synchronization or the number of period since a last full data frame was transmitted, for example. A data frame that comprises a shorter frame, for example, than the entire or complete data frame can be without the data bits having data related to the physical parameter. The shorter frame can comprise a keep alive counter, a symbol, a sensor identification bit(s), or start bits, for example. In response to a communication via a PSI5 interface, the start bits can be communicated, and when communicating via a DSI3 interface, for example, a symbol with the keep alive counter or the sensor identification bits can be all that is communicated or transmitted via the signal processing component 208 and sensor interface 106. Alternatively or additionally, the sensor communication can involve one or more of the above criteria or parameters as a part of the shorter frame, or any character, number of symbol, portion of data that is less than the full data frame or other communicated information that can indicate to the control unit that the sensor is functional or operational. For example, the ECU can utilize N synchronization periods, as discussed above to determine that the sensor is no longer operational. Depending upon the application or the particular sensor, the ECU reaction time could be different, and thus N can vary among different sensors of the system to detect a failure in sensor operation.

As another additional communication protocol, the sensors 102 or 204 can communicate in an increased current mode, in which the full, complete or entire data frame with start bits, symbols, counters, sensor ID, redundancy bits (e.g., parity bits or CRC bits), and data related to the physical parameter is communicated at every period, or every synchronizing period.

The processing pathways 116, 206 can each comprise a single link for communicating information such as the same detected physical quantity (e.g., magnetic field, pressure, light, etc. in a unit of measure, signal value, direction, amplitude or the like) in different representations. The first signal processing component 112 can be configured to operate upon a first output of a first interface link 120 and the second signal processing component 208 configured to operate upon a second output of the second interface link 210, in which each signal processing component can include one or more of normalizing components, temperature calibration components, filters, calculating components (e.g., angle calculations or the like), analog-to-digital components (ADC), protocol processors or control units comprising a processor or other device components for processing and performing operations related to each sensor. For example, the sensor processing component 112 and 208 can trigger a change in a communication protocol from one communication protocol to another different communication protocol independently in each of the sensors 102 and 204.

The system 200 includes the interface component 106 configured to provide a modulated signal output that is a function of the first sensor signal component or data representation and the second sensor signal component or data representation to a node or a pathway 122 that provides the data to another control unit 214, processing device or other component, such as an ECU or PCM for further utilization. The interface component 106 can operate as a digital interface component configured for modulation and transfer of a digital bit stream, for example, or as a different interface such as a pulse width modulation interface component for modulation or transfer of a pulse width modulated signal. For example, the interface component 106 can be a peripheral serial interface 5, a digital serial interface 3, or other interface link or connection type for communicating, modulating, or processing different signals from the two sensors 102 and 204.

Figure 3:
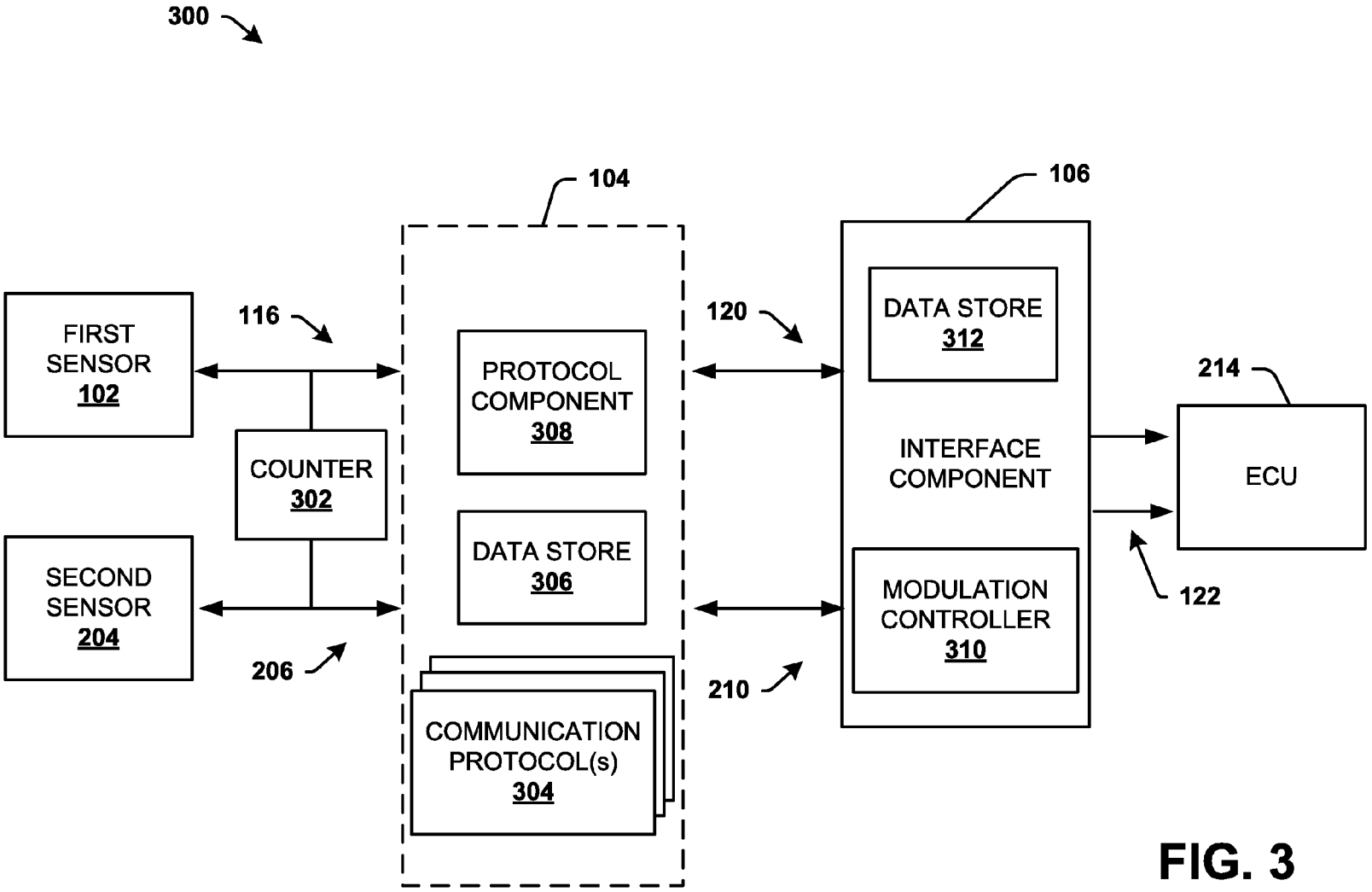
FIG. 3 is another block diagram of a vehicle sensor interface system in accordance with various aspects disclosed.

Referring now to FIG. 3, illustrated is an example of a vehicular sensor interface system that communicates sensor data in different communication protocols in accordance with various aspects described. The system 300 includes similar components as discussed above and further comprises a counter 302, one or more communication protocols 304 of the signal processing stage 104, a data store 306, a protocol component 308 and a modulation controller 310 coupled to a memory 312.

The counter 302, for example, can operate to count or increment at each synchronizing period or cycle of an oscillator (not shown). Each period can correspond to a data synchronization period utilized for synchronizing data from the sensors 102, 204 with one or more other components of the system 300, such as the control unit 214. The counter 302 can be coupled to signal paths 116, 206, to different pathways (e.g., 120, 210) or components of the system 100.

FIG. 3 is further described below with reference to FIGS. 4-6. While the methods described within this disclosure are illustrated in and described herein as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

The signal processing stage 104 of the system 300 comprises one or more data stores or a memory 306 and a plurality of communication protocols 304 for communicating sensor data of a physical parameter. The first sensor 102 or the second sensor 204 can operate to communicate the detected data of one or more physical parameters in different communication protocols 304 according to a trigger or protocol signal from the protocol component 308 or other component. The trigger can comprise an indication of which protocol to initiate communications from the sensor 102 or 204 to the interface component 106 or the ECU 214 or to which mode operation should be initiated that corresponds respectively to a communication protocol 304.

In one aspect, the trigger for a particular communication protocol can be based on a set of predetermined thresholds, in which each protocol could have a different threshold value for change that triggers the change to the particular communication protocol, or other predetermined criteria, as discussed above, such as a sensor priority depending upon a location and the related physical parameter being sensed, for example. A threshold can be a difference between a first measurement and a second measurement (e.g., a current measurement and a reference measurement) of the physical parameter being sensed (e.g., a pressure, magnetism, acceleration or other such physical parameter or property). The first threshold, for example, could indicate that a full data frame having all measured data bits is to be communicated at each synchronization period by the sensor as a different communication protocol, or that at least a portion of a full data frame (i.e., more than no data), but not a complete data frame, such as a portion of the data frame or a shorter frame could be communicated (e.g., a difference in the measurements, a difference in the transmitted data from one difference in measurements to another difference in measurements, start bits, a symbol, a keep alive counter value, a sensor ID, or the like). In addition, a second threshold could be determined that could be a greater difference value than for satisfying the first threshold of the same sensor, or a second threshold could be a threshold for a second different sensor, which either senses a same parameter as the first sensor or a different parameter. The second sensor can sense that a crash condition or accident condition has occurred with the vehicle, in which an accident mode or a crash mode of operate has been implemented by ECU or other control unit. This indication can be processed and trigger a second different communication protocol, in which each data frame is communicated as a full data frame with data related to the physical parameter at each synchronizing period, for example.

In another aspect, the communication can be related to a set of predetermined criteria, which can include information about each communication protocol, such as a maximum number of times less than all of the data frame or a shorter data frame than a complete data frame is to be sent, or where no data is sent regardless. In this case, a predetermined threshold could be a maximum counter value for sending less than all or the complete data frame. In response to the maximum being exceeded, then a full or complete data frame is sent by the sensor.

Additional criteria can also comprise a type of interface or a data interface that is available or being used. For example, in a typical sensor using PSI5, the following parameters are used: Voltage: about 6V; Idle current consumption: about 6 mA; Bit rate: about 189 kbps; Frame length: about 21 bits comprising about 2 start bits, about 16 data bits and about 3 CRC bits. Due to current modulation Manchester encoding (via, for example, the modulation controller 310), every bit consumes for half of the bit time, an additional current of about 26 mA. Therefore, on average the current consumption for a bit is about 13 mA. The idle power consumption can be: $P_{idle}$=6V*6 mA=36 mW, for example.

The classic data consumption of a sensor transmitting a full frame at every sync period can be represented, for example, as follows:

$$P_{data,sensor,c} = \frac{21}{\frac{189\text{ kbps}}{500\ \mu\text{s}}} 13\text{ mA}\cdot 6\text{ V} = 17.33\text{ mW}$$

Figure 4:
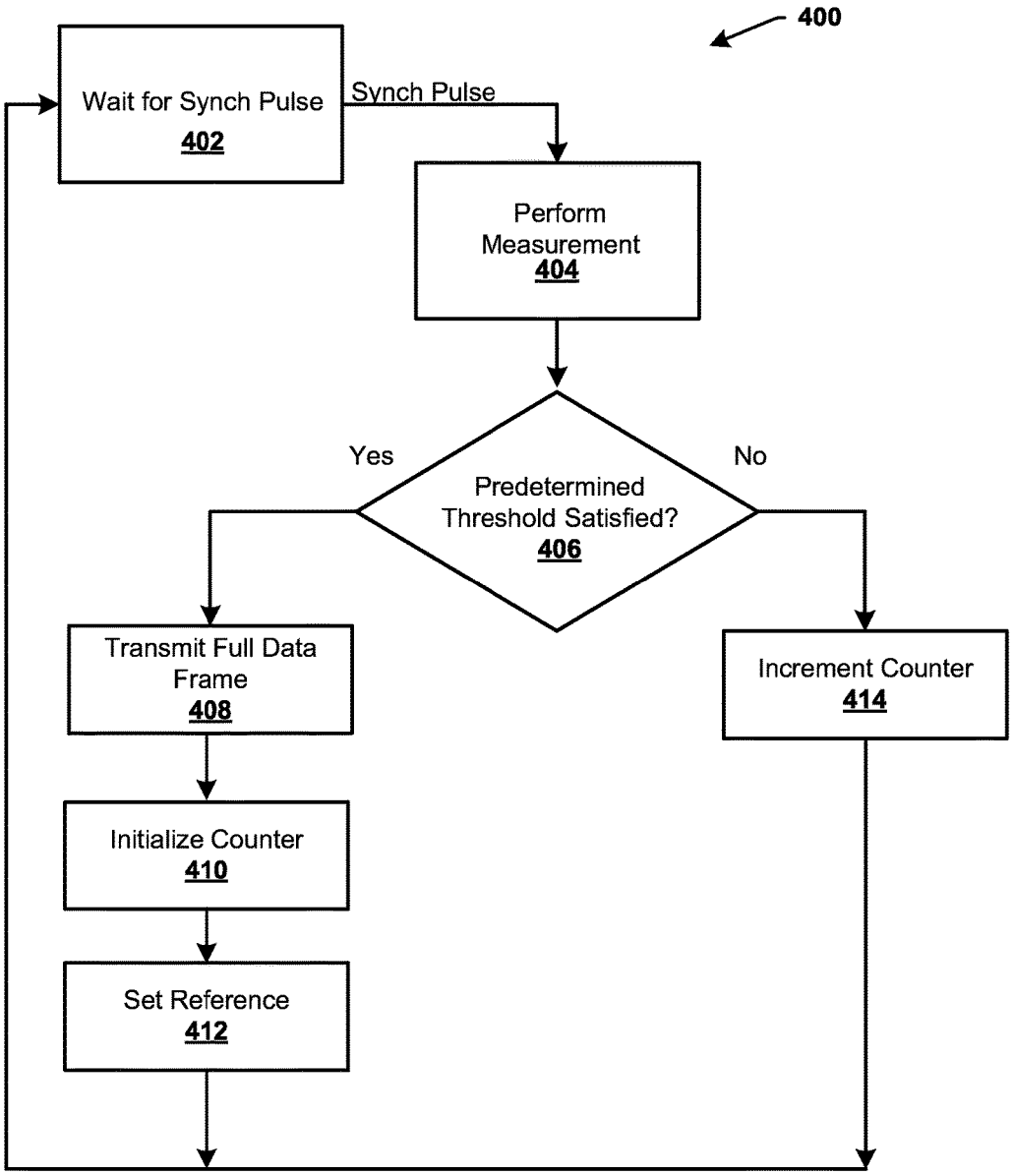
FIG. 4 is a process flow of a sensor interface system in accordance with various aspects disclosed.

Referring to FIG. 4, illustrated is a method 400 for one example of a communication protocol among the communication protocols 304 for sensor communications in a vehicular control system. At 402, the sensor (e.g., 102 or 204) waits to transmit or communicate data related to a physical parameter. In response to synchronization pulse, a clock edge, a clock period or the like, at 404 the sensor detects data related to the physical property.

At 406, a decision is made whether a predetermined threshold is satisfied (e.g., yes or no). The predetermined threshold, for example, can be represented as an absolute value of [m-r] being greater than a threshold value, in which m is an actual measurement by the sensor that has not yet been transmitted or communicated, and r is a reference measurement that can comprise the last transmitted measurement, a steady state condition of the current signal or a modulated current signal as related to the physical parameter being sensed, an average of measurements over a steady state condition of the current signal or modulated current signal, a stored reference value of the physical parameter, or another reference related to the physical parameter, for example. The predetermined threshold can thus comprise an absolute value or magnitude of the difference between the actual measurement (m) and the reference measurement (r). Alternatively or additionally, the predetermined threshold can be a threshold from another second sensor being satisfied, or a higher difference being detected than the first predetermined threshold value for a lower difference, which could indicate a crash mode or accident mode is being implemented.

Alternatively or additionally, the predetermined threshold for a communication protocol in FIG. 3 can be a maximum number of times by which the sensor transmits no data, in order for a check or an updated to occur with the control unit 214, for example.

In this example above, a first threshold for a particular communication protocol to be implemented can be a maximum number of times that less than the full data frame is communicated (e.g., N), such as no data frame or any of the bits within a full data frame would be transmitted. For example, the maximum number for less than the full data frame can be N synchronization period(s), such as N+1=8, according to one communication protocol, and the sensor could send one full data frame out of every eight transmissions and less than a full data frame, such as no data frame at N synchronization periods. Thus, $P_{data,\ i}=P_{data,c}/(N+1)$ =2.17 mW.

The sensor power consumption can thus be reduced by $P_{data,c}-P_{data,i}=15.16$ mW, which represents $$1-(P_{data,i}+P_{idle})/(P_{data,c}+P_{idle})=28\%.$$

On the ECU side, the system could have approximately three sensors per communication channel and about eight channels, for example. In this case, the typical power consumption for supplying all the sensors is, assuming an efficiency of the boost converter of 75% and the efficiency of the buck1 converter of 85%:

$$P_{idle,ECU,1} = (V_{SatIN} - V_{SatOUT}) \cdot I_{idle} + P_{Sat_{Buck1,Idle}} \cdot \left(\frac{1}{\mu_{Buck1}} - 1\right) \cdot \left(\frac{1}{\mu_{Boost}} - 1\right) = (7.75\text{ V} - 6\text{ V}) \cdot 6\text{ mA} + (7.75\text{ V} \cdot 6\text{ mA}) \cdot \left(\frac{1}{0.85} - 1\right) \cdot \left(\frac{1}{0.75} - 1\right) = 13.2\text{ mW}$$

$$P_{data,ECU,1} = (V_{SatIN} - V_{SatOUT}) \cdot I_{data} \cdot \left(\frac{\frac{frame_{length}}{baud_{rate}}}{\text{Period}}\right) + P_{Sat_{Buck1,Data}} \cdot \left(\frac{1}{\mu_{Buck1}} - 1\right) \cdot \left(\frac{1}{\mu_{Boost}} - 1\right) = 6.4\text{ mW}$$

$$P_{idle,ECU,Tot} = P_{idle,ECU,1} \cdot \#_{channels} \cdot \frac{\#_{sensors}}{\text{channel}} = 317.6\text{ mW}$$

$$P_{data,Tot} = P_{data,ECU,1} \cdot \#_{channels} \cdot \frac{\#_{sensors}}{\text{channel}} = 152.9\text{ mW}$$

The total power is:

$$P_{Tot} = (P_{data,Tot} + P_{idle,Tot}) \cdot \#_{channels} \cdot \frac{\#_{sensors}}{\text{channel}} = 470.6\text{ mW}$$

If N=7, then the power consumption would become:

$$P_{Tot,f=8} = (P_{data,Tot}/(N+1) + P_{idle,Tot}) \cdot \#_{channels} \cdot \frac{\#_{sensors}}{\text{channel}} = 336.8\text{ mW}$$

And the total power consumption reduction is:

$$P_{Tot}-P_{Tot,f=8}=133.8\text{ mW}$$

In response to the predetermined threshold being satisfied (e.g., Yes), at 408 a full data frame could be communicated at each synchronization period until the difference measurement drops to a steady state condition or below the threshold value, or an accident or crash mode is no longer being indicated. At 410, the counter can be initialized or set to zero to recount a number of times in which no dated is being communicated during the synchronization periods. In one aspect, at 412 the reference value can be set then to the transmitted value of the measurement data bits in the transmitted full data frame, and further stored in the memory or data store 306 or 312, for example.

In response to the predetermined threshold not being satisfied (e.g., No), then at 414 a counter can be incremented and no data or date frame bits are sent to the interface component 106 or control unit 214, for example.

Figure 5:
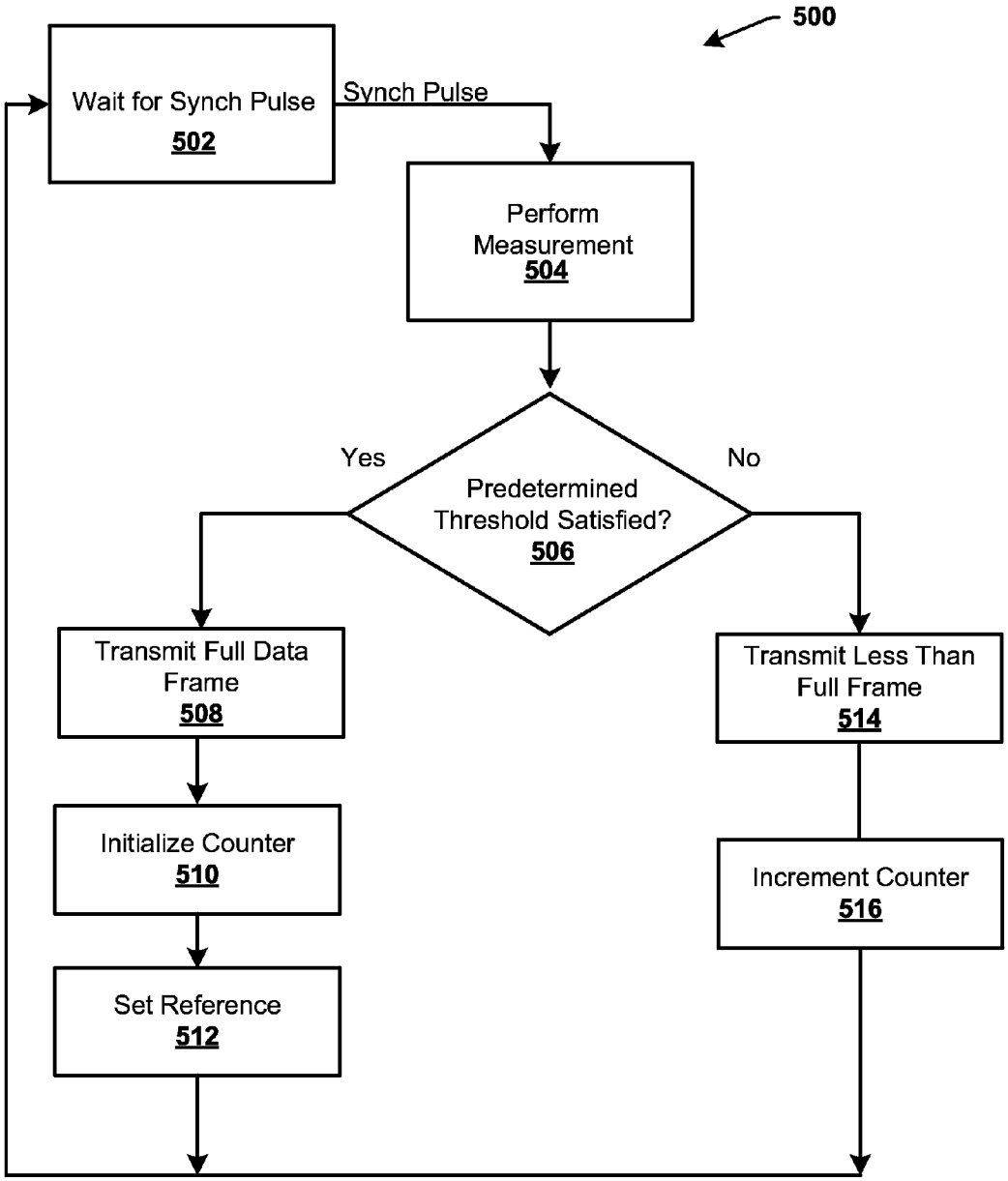
FIG. 5 is another process flow of a sensor interface system in accordance with various aspects disclosed.

Referring to FIG. 5, illustrated is another method 500 as an additional example of a different communication protocol among the communication protocols 304 for sensor communications in a vehicular control system. At 502, the sensor (e.g., 102 or 204) waits or listens for a trigger to transmit or communicate data related to a physical parameter. In response to synchronization pulse, an oscillator edge, a period or the like, at 504 the sensor detects data related to the physical property. The predetermined threshold 506 is similar to that discussed above.

For example, a threshold for the communication protocol to be implemented can be a maximum number of times that less than the full data frame is communicated, such as a data frame being a shorter data frame than the complete data frame, but more than no data frame as in the given example. For example, the maximum number for less than the full data frame can be N+1 synchronization period(s), such as N=7, then according to one communication protocol the sensor could send one full data frame out of every 8 transmissions and less than a full data frame such as a shorter data frame, which can include no data bits related to the physical parameter. A shorter data frame, for example, can comprise a set of start bits, in the case of a transmission or a communication occurring via a PSI5 interface of the interface component 106. Alternatively or additionally, the shorter data frame can comprise a symbol having a sensor ID or a counter value (e.g., a keep alive counter), or other data indicating an operational status of the sensor alone, for example, in the case of a communication occurring via a DSI3 interface, or other type interface link or connection.

In response to the decision 506 being yes, at 508 the system transmits a full data frame. At 510, the counter 302 is initialized or reset to zero and at 512 the reference value is set to the most recently transmitted measurement or other determined value, for example. In response to the decision 506 being no, less than a full data frame is transmitted at 514 for each synchronizing period or pulse. At 516, the counter for determining a number of times less than the full data set is transmitted is then incremented.

Using the typical parameters defined in the discussion of FIG. 4 above, a difference is in $P_{data,i}$. If N+1=8 is predetermined as a threshold value, then the sensor can send 7 times out of 8 only start bits, for example, or other short data frame that is shorter than a full data frame, as discussed above.

$$P_{data,sensor,i} = \frac{P_{data,c}}{N+1} + \frac{N}{N+1} \cdot \frac{2}{21} \cdot P_{data,c} = 3.61\text{ mW}$$

The sensor power consumption is still reduced by 13.72 mW or 26% in this mode of communication.

On the ECU side, the system can comprise, for example, 3 sensors per channel and 8 channels. In this case, the typical power consumption for supplying all the sensors is:

$$P_{Tot} = (P_{data,Tot} + P_{idle,Tot}) \cdot \#_{channels} \cdot \frac{\#_{sensors}}{\text{channel}} = 470.6\text{ mW}$$

If N=7 is the predetermined maximum threshold value for sending less than the full data frame, then the power consumption would become:

$$P_{data,ECU} + P_{idle,Tot} = \frac{P_{data,Tot}}{N+1} + \frac{N}{N+1} \cdot \frac{2}{21} \cdot P_{data,Tot} + P_{idle,Tot} = 349.5\text{ mW}$$

Figure 6:
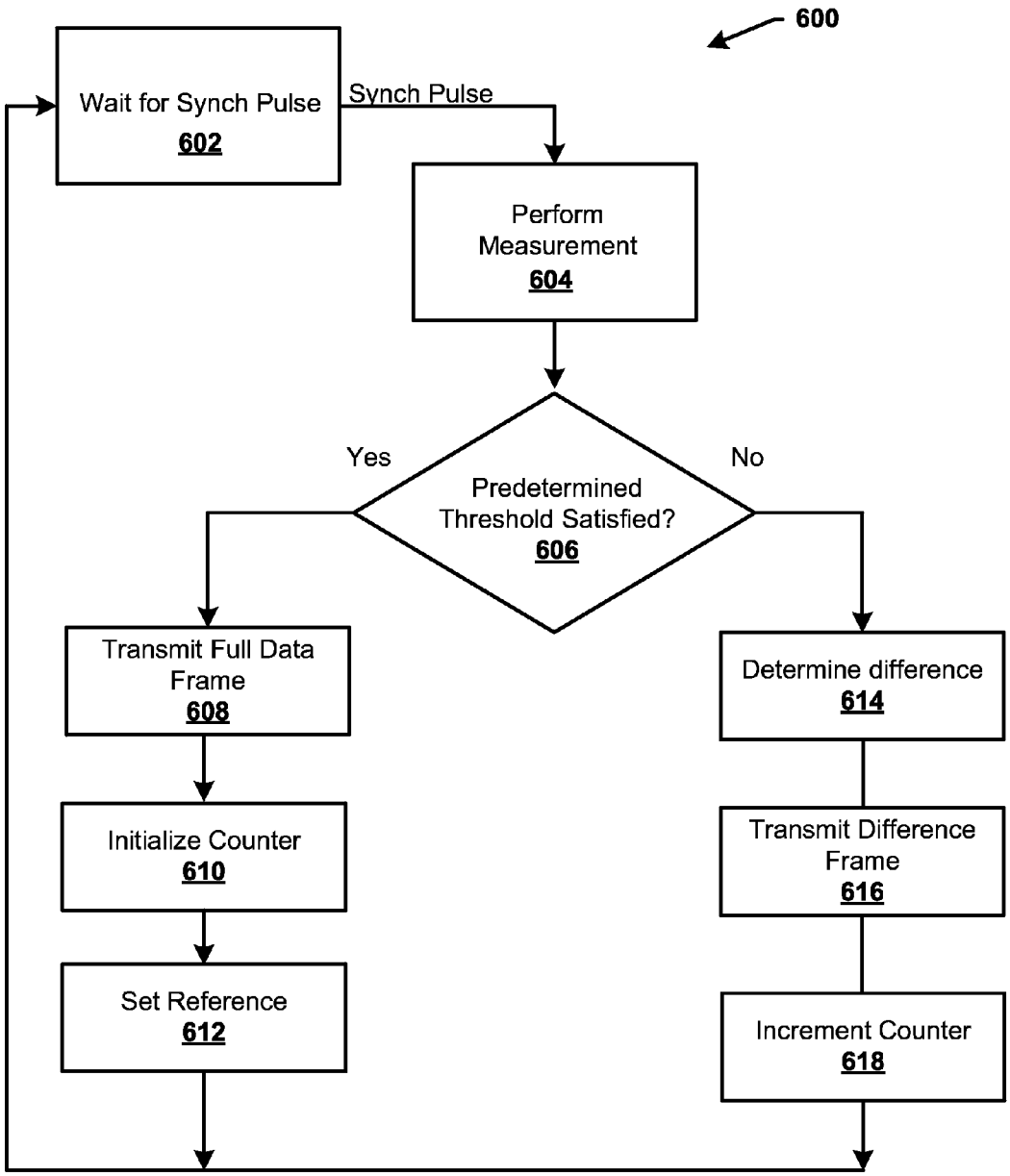
FIG. 6 is another process flow of a sensor interface system in accordance with various aspects disclosed.

Referring to FIG. 6, illustrated is a method 400 for one example of a communication protocol among the communication protocols 304 for sensor communications in a vehicular control system. At 602, the sensor (e.g., 102 or 204) waits to transmit or communicate data related to a physical parameter. In response to synchronization pulse, an oscillator edge, an oscillator period or the like, at 604 the sensor detects data related to the physical property. At 606, a decision is made whether a predetermined threshold is satisfied (e.g., yes or no). In response to the decision 606 being yes, at 608 the system transmits a full data frame. At 610, the counter 302 is initialized or reset to zero and at 612 the reference value is set to the most recently transmitted measurement or other determined value, for example. In response to the decision 606 being no, a difference is determined at 614 that is between two measurements. For example, one measurement can be an actual recent measurement and a reference or other measurement can comprise a previously transmitted measurement or other determined value related to data of the physical parameter. At 616, the difference is the only data transmitted in a shorter data frame than a full data frame. For example, the difference can be any slight change or change that is lower than a change to satisfy or trigger the predetermined threshold. This difference can be mapped in a graph or stored in a memory for further determining the reference value. At 618, the counter for determining a number of times less than the full data set is transmitted is then incremented.

In one example the threshold value c can be expressed in related to a difference d as $\varepsilon<\max(|d|)$ as predetermined threshold or a predetermined condition for a threshold in other words, in which d=m−r, or a difference of a first measurement and a second reference measurement, for example. In one example for a PSI5 interface, three bits can be selected to represent the difference d for the reference r in two's complement. The range of the difference d can then be from −3 to +4. Therefore, the threshold value can selected as c=3. In addition, to guarantee the integrity of the short frame, a parity bit can also be added to the communication as part of this particular protocol. The total length of the short frame is then 2+3+1=6 bits, for example. Using the typical parameters discussed above, there is only a difference in $P_{data,i}$. If N=7 is selected, then the sensor can send 7 times out of 8 the short frame.

$$P_{data,i} = \frac{P_{data,c}}{N+1} + \frac{N}{N+1} \cdot \frac{6}{21} \cdot P_{data,c} = 6.5 \text{ mW}$$

The sensor power consumption is still reduced by 10.8 mW or 20%. On the ECU side, if the system comprises three sensors per channel and either channels, as such for a normalized comparison case. In this case, the typical power consumption for supplying all the sensors is:

$$P_{Tot} = (P_{data,Tot} + P_{idle,Tot}) \cdot \#_{channels} \cdot \frac{\#_{sensors}}{\text{channel}} = 470.6 \text{ mW}$$

If N=7, then the power consumption would become:

$$P_{data,ECU} + P_{idle,Tot} = \frac{P_{data,Tot}}{N+1} + \frac{N}{N+1} \cdot \frac{6}{21} \cdot P_{data,Tot} + P_{idle,Tot} = 375 \text{ mW}$$

Figure 7:
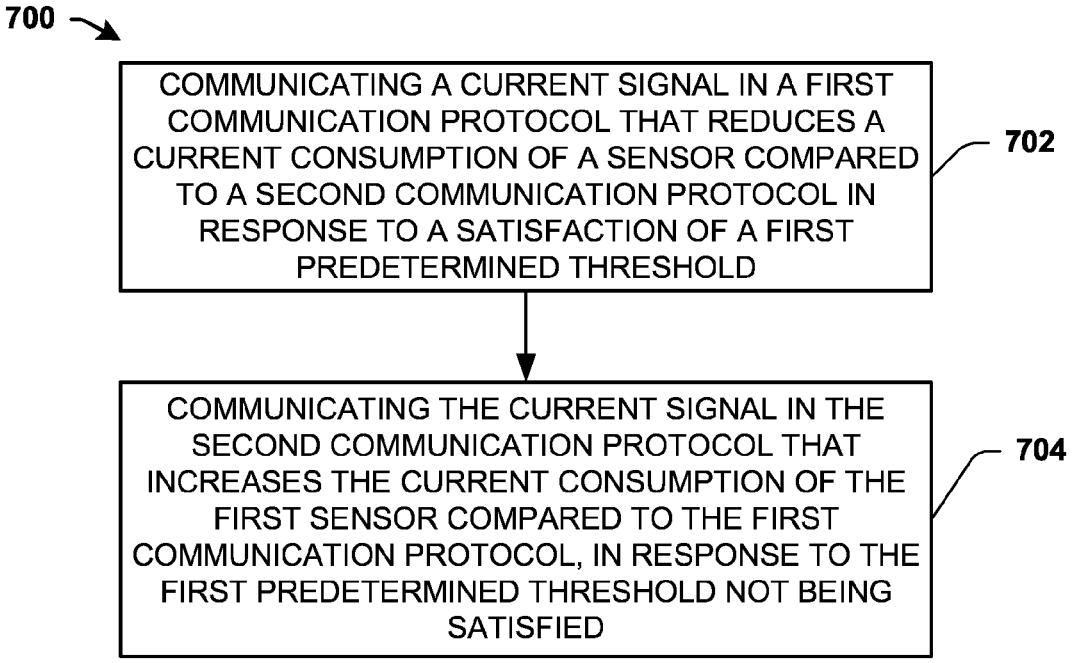
FIG. 7 is a process flow of a vehicle sensor interface system in accordance with various aspects disclosed.

Referring to FIG. 7, illustrated is a method 700 for sensor interface systems in accordance with aspects disclosed. The method 700 initiates at 702 and comprises communicating a current signal, via a sensor interface coupled to an engine control component, in a first communication protocol that reduces a current consumption of a first sensor compared to a second communication protocol, in response to a first predetermined threshold being satisfied. At 704, the method further comprises communicating the current signal, via the sensor interface coupled to the engine control component, in the second communication protocol that increases the current consumption of the first sensor compared to the first communication protocol, in response to the first predetermined threshold not being satisfied.

The predetermined threshold can be determined, for example, based on a difference of a measurement of a physical parameter with a reference measurement, based on whether an indication of a crash mode or accident mode by the first sensor or a second different sensor has been received, based on whether a counter value or counter threshold has been reached, or one or more different criteria as discussed herein. In this manner, the predetermined thresholds discussed herein can comprise different conditions as predetermined conditions also, as well as be dynamically modified within a single sensor or independently among multiple different sensors.

Applications (e.g., program modules) can include routines, programs, components, data structures, etc., that perform particular tasks or implement particular abstract data types. Moreover, those skilled in the art will appreciate that the operations disclosed can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated devices.

A computing device can typically include a variety of computer-readable media. Computer readable media can be any available media that can be accessed by the computer and includes both volatile and non-volatile media, removable and non-removable media. By way of example and not limitation, computer-readable media can comprise computer storage media and communication media. Computer storage media includes both volatile and non-volatile, removable and non-removable media implemented in any method or technology for storage of information such as computer-readable instructions, data structures, program modules or other data. Computer storage media (e.g., one or more data stores) can include, but is not limited to, RAM, ROM, EEPROM, flash memory or other memory technology, CD ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

It is to be understood that aspects described herein may be implemented by hardware, software, firmware, or any combination thereof. When implemented in software, functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if software is transmitted from a website, server, or other remote source using a coaxial cable, fiber optic cable, twisted pair, digital subscriber line (DSL), or wireless technologies such as infrared, radio, and microwave, then coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Various illustrative logics, logical blocks, modules, and circuits described in connection with aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor may be a microprocessor, but, in the alternative, processor may be any conventional processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration. Additionally, at least one processor may comprise one or more modules operable to perform one or more of the acts and/or actions described herein.

For a software implementation, techniques described herein may be implemented with modules (e.g., procedures, functions, and so on) that perform functions described herein. Software codes may be stored in memory units and executed by processors. Memory unit may be implemented within processor or external to processor, in which case memory unit can be communicatively coupled to processor through various means as is known in the art. Further, at least one processor may include one or more modules operable to perform functions described herein.

Techniques described herein may be used for various wireless communication systems such as CDMA, TDMA, FDMA, OFDMA, SC-FDMA and other systems. The terms "system" and "network" are often used interchangeably. A CDMA system may implement a radio technology such as Universal Terrestrial Radio Access (UTRA), CDMA2000, etc. UTRA includes Wideband-CDMA (W-CDMA) and other variants of CDMA. Further, CDMA2000 covers IS-2000, IS-95 and IS-856 standards. A TDMA system may implement a radio technology such as Global System for Mobile Communications (GSM). An OFDMA system may implement a radio technology such as Evolved UTRA (E-UTRA), Ultra Mobile Broadband (UMB), IEEE 802.11 (Wi-Fi), IEEE 802.16 (WiMAX), IEEE 802.20, Flash-OFDM, etc. UTRA and E-UTRA are part of Universal Mobile Telecommunication System (UMTS). 3GPP Long Term Evolution (LTE) is a release of UMTS that uses E-UTRA, which employs OFDMA on downlink and SC-FDMA on uplink. UTRA, E-UTRA, UMTS, LTE and GSM are described in documents from an organization named "3rd Generation Partnership Project" (3GPP). Additionally, CDMA2000 and UMB are described in documents from an organization named "3rd Generation Partnership Project 2" (3GPP2). Further, such wireless communication systems may additionally include peer-to-peer (e.g., mobile-to-mobile) ad hoc network systems often using unpaired unlicensed spectrums, 802.xx wireless LAN, BLUETOOTH and any other short- or long-range, wireless communication techniques.

Single carrier frequency division multiple access (SC-FDMA), which utilizes single carrier modulation and frequency domain equalization is a technique that can be utilized with the disclosed aspects. SC-FDMA has similar performance and essentially a similar overall complexity as those of OFDMA system. SC-FDMA signal has lower peak-to-average power ratio (PAPR) because of its inherent single carrier structure. SC-FDMA can be utilized in uplink communications where lower PAPR can benefit a mobile terminal in terms of transmit power efficiency.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer-readable media can include but are not limited to magnetic storage devices (e.g., hard disk, floppy disk, magnetic strips, etc.), optical discs (e.g., compact disc (CD), digital versatile disc (DVD), etc.), smart cards, and flash memory devices (e.g., EPROM, card, stick, key drive, etc.). Additionally, various storage media described herein can represent one or more devices and/or other machine-readable media for storing information. The term "machine-readable medium" can include, without being limited to, wireless channels and various other media capable of storing, containing, and/or carrying instruction(s) and/or data. Additionally, a computer program product may include a computer readable medium having one or more instructions or codes operable to cause a computer to perform functions described herein.

Further, the acts and/or actions of a method or algorithm described in connection with aspects disclosed herein may be embodied directly in hardware, in a software module executed by a processor, or a combination thereof. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to processor, such that processor can read information from, and write information to, storage medium. In the alternative, storage medium may be integral to processor. Further, in some aspects, processor and storage medium may reside in an ASIC. Additionally, ASIC may reside in a user terminal. In the alternative, processor and storage medium may reside as discrete components in a user terminal. Additionally, in some aspects, the acts and/or actions of a method or algorithm may reside as one or any combination or set of codes and/or instructions on a machine-readable medium and/or computer readable medium, which may be incorporated into a computer program product.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature may have been disclosed with respect to only one of several implementations, such feature may be combined with one or more other features of the other implementations as may be desired and advantageous for any given or particular application.

What is claimed is:

1. A vehicle system comprising:

a controller configured to receive a current signal related to a physical parameter in a first communication protocol from a first sensor;

a communication link coupled to the first sensor and to the controller and configured to communicate the current signal; and a protocol component configured to detect one or more properties of the current signal and determine whether a first predetermined threshold related to a change of the physical parameter is satisfied based on the one or more properties and modify the first communication protocol of the first sensor to a second communication protocol in response to a satisfaction of the first predetermined threshold.

2. The vehicle system of claim 1, wherein the first sensor is configured to communicate the current signal in the first communication protocol by communicating less than a complete data frame or data word at each data synchronization period of a number of N synchronization periods, wherein N is an integer that is at least 1.

3. The vehicle system of claim 2, wherein the first sensor is configured to communicate the complete data frame or data word at an interval comprising at least N+1 of the number of synchronization periods.

4. The vehicle system of claim 2, wherein the less than the complete data frame or data word comprises a shorter data frame than the complete data frame or data word that comprises a data symbol having at least one of a start bit, a keep-alive counter value or a sensor ID without a data that is indicative of the physical parameter.

5. The vehicle system of claim 2, wherein the less than the complete data frame or data word comprises a difference between an actual measurement of the physical parameter and a reference measurement from at least one previous measurement transmitted by the first sensor.

6. The vehicle system of claim 1, wherein the first sensor is configured to communicate the current signal in the second communication protocol by communicating a complete data frame or data word at each synchronization period in response to the change of the physical parameter between an actual measurement and a reference measurement exceeding the first predetermined threshold.

7. The vehicle system of claim 1, wherein the first sensor is configured to communicate the current signal in the second communication protocol by communicating a complete data frame or data word at a synchronization period in response to a counter generating a counter value that satisfies a second predetermined threshold for a number of N synchronization periods.

8. The vehicle system of claim 1, wherein the communication link comprises an interface comprising a peripheral sensor interface 5 link or a digital serial interface 3 link that is configured to connect the first sensor to the controller.

9. The vehicle system of claim 1, wherein the protocol component is further configured to modify the first communication protocol of the first sensor to the second communication protocol in response to detecting an accident mode of operation based on a communication from a second sensor satisfying a second predetermined threshold related to another change of the physical parameter or a different physical parameter.

10. The vehicle system of claim 9, wherein the first sensor is configured to reduce an amount of current consumption over an operation period in response to communicating in the first communication protocol.

11. A method for a control system comprising:

communicating a current signal, via a sensor interface coupled to a controller, in a first communication protocol that reduces a current consumption of a first sensor compared to a second communication protocol, in response to a first predetermined threshold being satisfied; and communicating the current signal, via the sensor interface coupled to the controller, in the second communication protocol that increases the current consumption of the first sensor compared to the first communication protocol, in response to the first predetermined threshold not being satisfied.

12. The method of claim 11, further comprising:

determining whether the first predetermined threshold is satisfied based on a difference of a measurement of a physical parameter with a reference measurement or based on receiving an indication of a crash mode or accident mode by the first sensor or a second different sensor.

13. The method of claim 11, wherein the communicating the current signal in the first communication protocol comprises communicating less than an entire data word or an entire data frame related to the physical parameter at each synchronization period of N synchronization periods, and communicating the entire data word or the entire data frame in response to a counter value of synchronization periods being greater than N, wherein N is an integer of at least two.

14. The method of claim 13, wherein the communicating the less than the entire data word or the data frame comprises communicating a difference between a measurement and a reference measurement related to the physical parameter at each synchronization period of the N synchronization periods.

15. The method of claim 11, wherein the communicating the current signal in the second communication protocol comprises communicating an entire data word or data frame related to the physical parameter at each synchronization period via a peripheral sensor interface 5 protocol or a digital serial interface 3 of the sensor interface.

16. A control system comprising:

a first sensor configured to detect a physical parameter and communicate a modulated current signal related to the physical parameter to a controller according to a first communication protocol of a plurality of communication protocols based on a set of predetermined criteria;

a sensor interface component of the controller configured to process the modulated current signal from the first sensor according to at least one of the plurality of communication protocols; and a protocol component configured to detect one or more properties of the modulated current signal from the first sensor and determine whether a first predetermined threshold to a change of the physical parameter is satisfied based on the one or more properties.

17. The control system of claim 16, wherein the protocol component is further configured to communicate a trigger signal to facilitate the first sensor to generate communications in a second communication protocol of the plurality of communication protocols that is different from the first communication protocol.

18. The control system of claim 16, wherein the protocol component is further configured to determine whether the first predetermined threshold is satisfied based on a comparison between a measurement of the physical parameter and a reference measurement, or based on a second predetermined threshold of a different physical parameter or the same physical parameter being satisfied that indicates a crash mode or an accident mode of operation is activated, wherein the reference measurement is derived from at least one of a previous measurement transmitted by the first sensor, a steady state condition of the modulated current signal, or a stored reference value in a memory.

19. The control system of claim 16, wherein the first sensor is further configured to communicate a shorter data frame than a complete date frame of the modulated current signal to the controller based on a determination by the protocol component that the first predetermined threshold is not satisfied.

20. The control system of claim 16, wherein the first sensor is further configured to communicate a complete data frame of the modulated current signal to the controller according to a different communication protocol of the plurality of communication protocols that generates an increase of current consumption compared to the first communication protocol based on a determination by the protocol component that the first predetermined threshold is satisfied.

21. The control system of claim 16, wherein the protocol component is further configured to detect one or more different properties of at least a portion of a different modulated current signal from a second sensor, determine whether a second predetermined threshold to a different physical parameter has been satisfied, and facilitate a second communication protocol of the plurality of communication protocols that is different from the first communication protocol in the first sensor in response to a crash mode or an accident mode being determined based on a satisfaction of the second predetermined threshold.

22. The control system of claim 16, wherein the sensor interface component of the controller is further configured to receive the modulated current signal from the first sensor via an interface component comprising a peripheral sensor interface 5 connection or a digital serial interface 3 connection that is configured to connect a plurality of sensors to the controller.

23. The control system of claim 16, wherein the set of predetermined criteria comprising a number of N periods to communicate a shorter data frame than a complete date frame of the modulated current signal, wherein N comprises an integer equal to or greater than one in response to a determination by the protocol component that the first predetermined threshold to the change of the physical parameter is not satisfied and N comprises the integer equal to N+1 in response to a satisfaction of the first predetermined threshold.

24. The control system of claim 16, wherein the first sensor is configured to communicate a difference of a measurement of the physical parameter with a reference measurement instead of a complete data frame of the modulated current signal based on the set of predetermined criteria, wherein the set of predetermined criteria comprises a number of N periods to communicate the difference at each period, wherein N comprises an integer equal to or greater than one, and in response to a first determination by the protocol component that the first predetermined threshold to the change of the physical parameter is not satisfied.

25. The control system of claim 16, wherein the first sensor is further configured to communicate in the first communication protocol in a current saving mode to reduce an average current consumption over a duration of time by communicating a complete data frame of the modulated current signal after only communicating less than the complete data frame for a number of a plurality of synchronization periods.

* * * * *